US005868057A

United States Patent [19]

Kapolnek

[11] Patent Number: 5,868,057

[45] Date of Patent: Feb. 9, 1999

[54] PERFORATION RULE FOR ROTARY CUTTING SYSTEM

[75] Inventor: Paul G. Kapolnek, Chicago, Ill.

[73] Assignee: Western Printing Machinery Company, Schiller Park, Ill.

[21] Appl. No.: 685,287

[22] Filed: Jul. 23, 1996

[51] Int. Cl.[6] ..... B26F 1/20

[52] U.S. Cl. ..... 83/660; 83/346; 83/678

[58] Field of Search ..... 83/30, 332, 346, 83/347, 660, 663, 678, 695, 854, 599, 670, 674, 687, 689, 866, 867, 691; 30/351, 355; 76/107.8; 493/63

[56] References Cited

U.S. PATENT DOCUMENTS

| | | | |
|---|---|---|---|
| 371,736 | 10/1887 | Burton | 83/678 X |
| 1,441,708 | 1/1923 | Overbury | 83/332 |
| 1,710,142 | 4/1929 | Berg | 30/355 X |
| 2,266,958 | 12/1941 | Corbin | 428/43 |
| 2,401,310 | 6/1946 | Mayhew | 83/695 |
| 2,799,930 | 7/1957 | Champlin | 30/355 |
| 2,825,407 | 3/1958 | Widell | 83/687 |
| 2,842,202 | 7/1958 | Boyd | 83/678 |
| 2,973,578 | 3/1961 | Carroll et al. | 30/355 |
| 3,120,777 | 2/1964 | Genin | 83/674 X |
| 3,147,658 | 9/1964 | Boyd | 83/660 X |
| 3,205,750 | 9/1965 | Strange | 83/660 |
| 3,394,866 | 7/1968 | Silver | 229/135 |
| 3,427,912 | 2/1969 | Nozawa et al. | 83/678 X |
| 3,463,039 | 8/1969 | Silver | 83/660 X |
| 3,813,977 | 6/1974 | Hibbing et al. | 83/345 |
| 3,860,158 | 1/1975 | Aspinwall | 83/854 X |
| 4,706,533 | 11/1987 | Giulie | 83/660 X |
| 5,117,721 | 6/1992 | Montrose | 83/660 |
| 5,448,833 | 9/1995 | Coon | 30/355 X |
| 5,492,041 | 2/1996 | Valkanov | 83/133 |

FOREIGN PATENT DOCUMENTS

| | | | |
|---|---|---|---|
| 1010776 | 5/1977 | Canada | 83/678 |
| 0 086 419 | 8/1983 | European Pat. Off. . | |
| 1470905 | 1/1967 | France . | |
| 2241390 | 3/1975 | France . | |
| 559 425 | 9/1932 | Germany . | |
| 823694 | 12/1951 | Germany | 83/345 |
| 44 31 645 | 3/1996 | Germany . | |
| 12904 | of 1908 | United Kingdom | 83/345 |
| 582656 | 11/1946 | United Kingdom . | |
| 2 174 948 | 11/1986 | United Kingdom | 83/678 |
| WO 82/00432 | 2/1992 | WIPO . | |

*Primary Examiner*—Clark F. Dexter
*Attorney, Agent, or Firm*—Brinks Hofer Gilson & Lione

[57] ABSTRACT

The invention provides a perforation cutting rule for a rotary cutting machine and method of operating the same. The cutting rule has a length, height and thickness and includes a plurality of dovetail-shaped gaps formed along a longitudinal edge to define a plurality of dovetail-shaped cutting teeth. Each tooth includes an outer cutting end and an inner base end, the outer cutting end having a length greater than an inner base end. As the cutting end cuts through multiple sheets the angled sides of the dovetail-shaped teeth provide a relief area to prevent the sheets from bunching or pulling against the teeth during the cutting operation.

3 Claims, 3 Drawing Sheets

PERFORATION RULE FOR ROTARY CUTTING SYSTEM

BACKGROUND OF THE INVENTION

The invention relates generally to cutting rules that are used with rotary cutters for perforating web or sheet material. More particularly, the invention relates to an improved perforation cutting rule having a tapered or dovetail-shaped tooth design, and method of operating the same to cut perforations in a moving multiple layered web.

BACKGROUND OF THE INVENTION

It is conventional practice to use a rotary cutter to transversely cut web material received from a printing press. In general, rotary cutters have an anvil cylinder and a knife cylinder which are rotatable in timed relation. One or more knives or cutting rules are attached to the knife cylinder. The knife and anvil cylinders normally rotate at the same speed and the moving paper or web material may be transversely and/or longitudinally cut or perforated as the cutting rule moves into and out of engagement with the anvil surface. The cutting rules may be straight or curved, and mounted on the knife cylinder in various positions including longitudinally, transversely, diagonally, and combinations of these to create the desired cut. In general, as shown for example in FIG. 3, existing perforation rules are designed with rectangular gaps 54 that form teeth 56 that are rectangular and have a straight top edge 50 and sides 58 extending perpendicular from the top edge. The base 52 of these teeth has a length the same as the top edge 50. Some existing rules have teeth with a base having a greater length than the top edge.

One problem with the rectangular tooth design is encountered when cutting web for multiple page booklets or mailers, which requires multiple stacked sheets to be perforated. As shown in FIG. 6, as each cutting tooth 56 cuts through the multiple sheets 60, the cut sheets tend to bunch-up around the sides 58 of the tooth. This bunching may exert excessive load on the cutting assembly, and often prevents the teeth from cutting completely through to the bottom of stacked sheets 60. Moreover, the bunching may cause tears or creases or bulges in the top sheets. Accordingly, the resulting booklet may have a torn or uncitely appearance and may be difficult to tear open along the perforated line.

Another problem results as the teeth pull away from the cut stacked sheets. As shown in FIG. 7, the sheets 60 tend to grab onto the teeth as the tooth 56 rotates away from the sheets 60. This may pull the sheets 60 off the cylinder causing the rotary cutter to jam, halting operation, and possibly damaging or destroying the cutting rule. The bunching and grabbing of the multiple sheets may also weaken and/or bulge the tie 62 between the perforations, and accordingly adversely effect the appearance of the finished product.

It would be desirable to have a perforation cutting rule for a rotary cutter having a tooth design that would prevent bunching and grabbing, provide clean cuts through multiple sheets and provide a perforated end product with a smooth, flat appearance, and that is sufficiently easy to tear along the perforated line.

SUMMARY OF THE INVENTION

One aspect of the invention provides a rotary cutting rule including a body portion and a plurality of cutting teeth extending outward from the body portion. Each tooth has an outer cutting edge and sides which extend outward from the body, the sides forming an angle of less than 90 degrees with the outer cutting edge. This provides a relief area along the sides of the teeth which prevents the cut sheet material from bunching along and grabbing the sides of the tooth. Preferably, each tooth includes two sides, each of which forms an angle of less than 90 degrees with the cutting edge. Preferably, the angle formed between the side and the outer cutting edge are substantially the same for each side. Preferably the teeth have bevelled cutting edges, which will provide additional relief of the cut sheets along the faces of the tooth.

Another aspect of the invention provides for a cutting rule for a rotary cutter including a body portion having a length, height and thickness, and a plurality of cutting teeth extending outward along the longitudinal side of the body portion. Each tooth has an outer cutting edge and sides which extend outward from the longitudinal side of the body portion. Each tooth includes an angled side edge forming an angle of less than 90 degrees with the longitudinal side of the body portion exposed between the teeth. Each tooth preferably includes two sides. Preferably, the angle formed between the side of each tooth and the longitudinal side of the body portion are substantially the same for each side. Preferably, the teeth have bevelled cutting edges. Preferably, each tooth has a thickness substantially equal to the thickness of the body portion, which will allow the metal rule to be efficiently machined to form the cutting teeth.

Another aspect of the invention provides rotary cutting apparatus including a cutting rule having a length, height and thickness. The cutting rule includes a plurality of dovetail-shaped gaps formed along a longitudinal edge to define a plurality of dovetail-shaped cutting teeth. Each tooth includes an outer end and an inner base end. The outer end has a length greater than an inner base end. Preferably the outer end of each tooth is bevelled. Preferably the tooth is bevelled on each face of the outer end.

Another aspect of the invention provides for a method of operating rotary cutting apparatus. A perforation cutting rule having a plurality of dovetail-shaped teeth is provided. Each tooth has a cutting edge and base. The cutting edge has a length greater than the base. Slits are cut through sheet material with the dovetail-shaped teeth while providing a relief area adjacent sides of the teeth to prevent the cut sheet material from bunching or pulling against the sides of the teeth. The sheet material may include multi-layered sheet material. Preferably the cutting edge is bevelled. Preferably the dovetail-shaped teeth are substantially the same size and shape.

The foregoing and other features and advantages of the present invention will become further apparent to those skilled in the art upon review of the following detailed description of the presently preferred embodiments of the invention taken in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
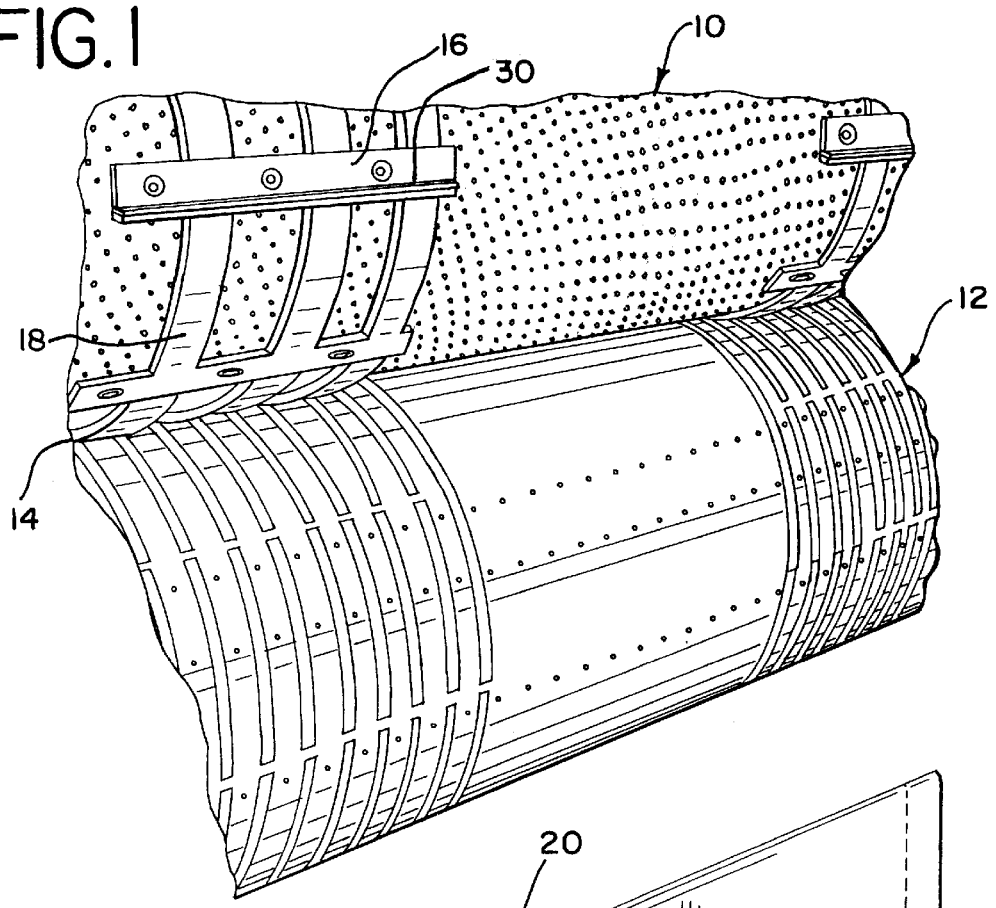
FIG. 1 is a perspective view of a rotary cutter with a cutting rule mounted on the knife cylinder.
Figure 10:
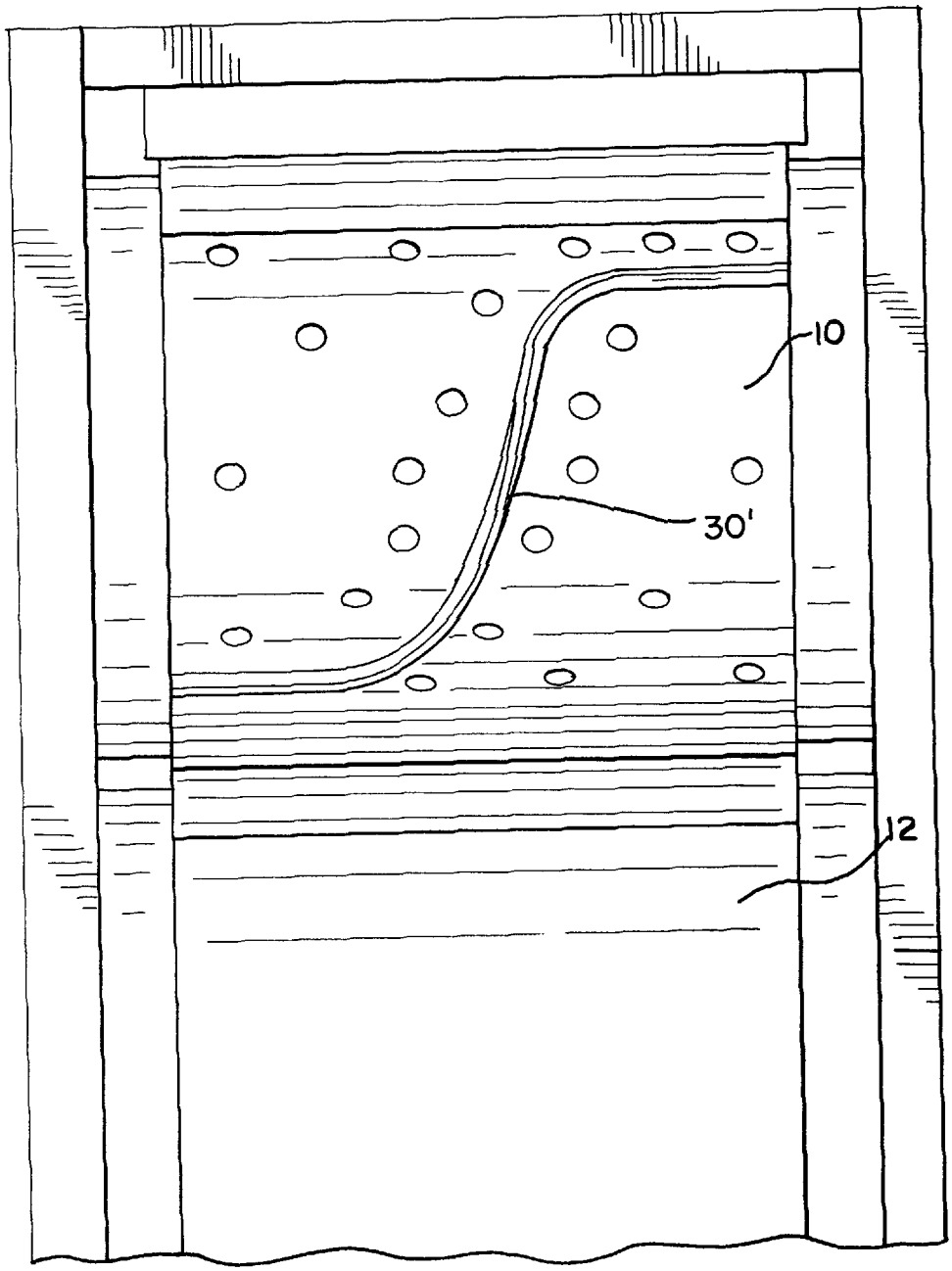
FIG. 10 is a front elevational view of a rotary cutter with an alternative cutting rule mounted on the knife cylinder.

Referring to FIG. 1, there is shown a perspective view of a rotary cutter having a knife cylinder 10 and anvil cylinder 12. A cutting rule 30 is shown attached to a knife holder 16, which is mounted to the knife cylinder 10. As shown in FIG. 1, the knife holder 16 is mounted to transversely cut the web as it moves through the nip 14 formed between the knife cylinder 10 and anvil cylinder 12. The cutting rule may also be positioned longitudinally, diagonally, or at any curved orientation to achieve the desired perforation. For example, as shown in FIG. 10, an S-shaped cutting rule 30 is shown mounted on the knife cylinder 10. The knife holder may be sized to cover greater portions of the knife cylinder 10, and numerous individual knife holders may be mounted on the knife cylinder. Rubber cushioning 18 facilitates the driving of the web through the cylinders 10, 12 and acts to keep the web taut while it is cut.

Figure 2:
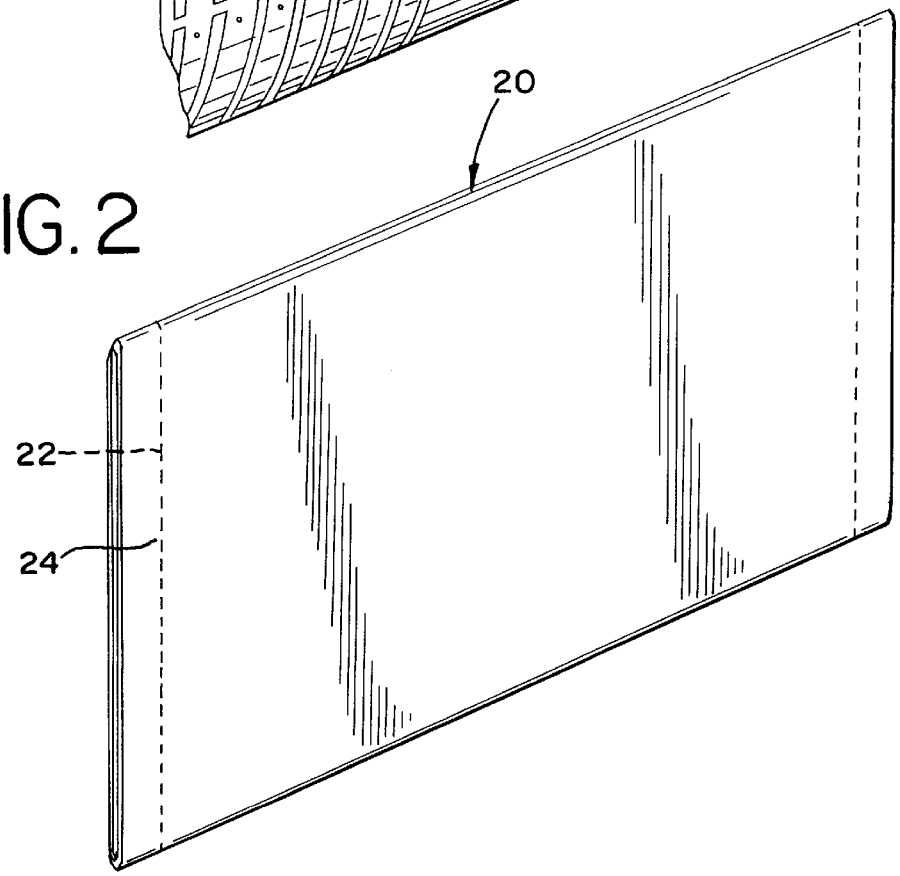
FIG. 2 is a perspective view of a multi-sheet booklet having perforations along its sides.
Figure 3:
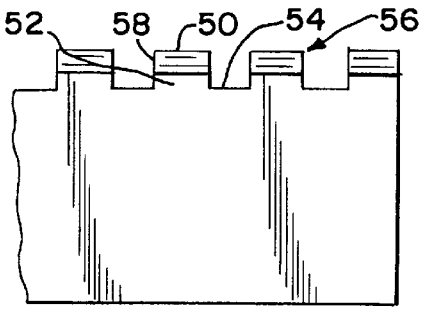
FIG. 3 PRIOR ART
FIG. 3 is a side elevational view of a prior art perforation cutting rule having rectangular-shaped teeth.

FIG. 2 illustrates a multi-sheet booklet 20, which was perforated along its longitudinal ends using a rotary cutter. The perforations 22 are slits made preferably through the entire thickness of the multiple sheet booklet to allow a user to tear off the longitudinal end portions. The ties 24 are the areas contiguous to and between the perforations or slits 22. Ideally, the ties are smooth and flat, and the slits through each sheet have a substantially identical length.

Figure 4:
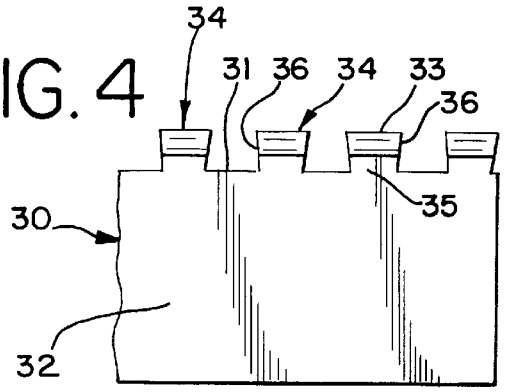
FIG. 4 is a side elevational view of a preferred embodiment of the perforation cutting rule having dovetail-shaped teeth made in accordance with the invention.

Referring to FIG. 4, an embodiment of a perforation cutting rule 30 is shown having body portion 32 and teeth 34. The teeth have a dovetail shape which allows the teeth to cut through multiple layers of sheet material. For example, in a preferred embodiment, the cutting rule may have a height of 0.375 inch. The body portion 32 of the cutting rule 30, for this embodiment, is generally rectangular having a height of 0.315 inch and a thickness of 0.028 inch. The length of the body may vary to achieve the desired perforation. For this embodiment, the teeth may extend 0.06 inch from the longitudinal side 31 of the body. The cutting edge 33 of each tooth may measure 0.08 inch, and a base 35 of each tooth may measure 0.065 inch. For this embodiment, the distance between cutting edges may be 0.063 inch, and the distance between each tooth base may be 0.078 inch. For this embodiment, the sides 36 of the teeth are angled outward from the tooth base 35 with a slope of, for example, 0.015 inch for the 0.06 inch height of the tooth, or 1 to 4. The angle formed between the longitudinal side 31, which is in between the teeth 34, and the sides 36 of teeth 34 is less than 90 degrees. Preferably the angle is in a range of about 70 to 80 degrees. The angle formed between the sides 36 of the teeth 34 and the cutting edge of the teeth is also less than 90 degrees. And, preferably, the angle is in a range of about 70 to 80 degrees. Preferably, the angle formed between each side 36 and longitudinal side 31 is substantially the same as the angle formed between the cutting edge 33 and side 36.

Figure 8:
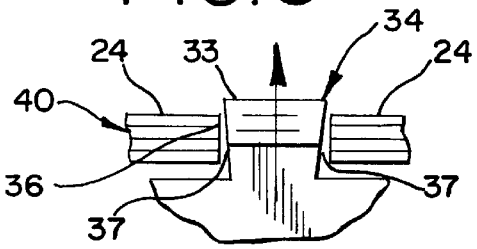
FIG. 8 is a side view of a preferred embodiment dovetail-shaped tooth cutting through multiple sheets.
Figure 9:
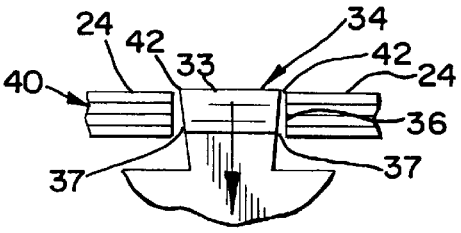
FIG. 9 is a side view of a preferred embodiment dovetail-shaped tooth pulling away from the cut multiple sheets.

As shown in FIG. 8, as the tooth 34 cuts into the multi-layered web 40, the cut sheets are not pulled inward by the sides 36. The angled side edges 36 of the dovetail-shaped tooth 34 provide the necessary relief area 37 to avoid the bunching and pulling which occurs along the sides of the teeth when using the rectangular-shaped teeth. Referring to FIG. 9, likewise, as the tooth 34 pulls away from the web 40, the only surface area on the sides of the dovetail tooth that may contact with the cut sheets is at the tip 42. Accordingly, the tendency of the web 40 to separate from the knife cylinder 10 is greatly reduced. Also, the lack of pulling and bunching when using the dovetail-shaped teeth 34 substantially eliminates torn and/or bulging ties 24.

Figure 5:
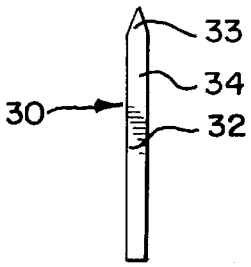
FIG. 5 is an end view of an embodiment of invention having bevelled cutting teeth.
Figure 6:
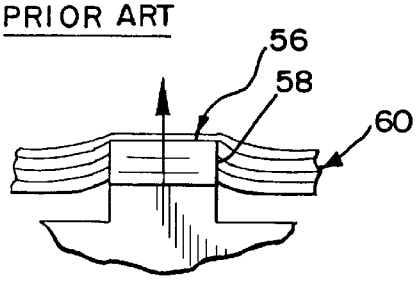
FIG. 6 PRIOR ART
FIG. 6 is a side view of a prior art rectangular-shaped tooth cutting through multiple sheets.
Figure 7:
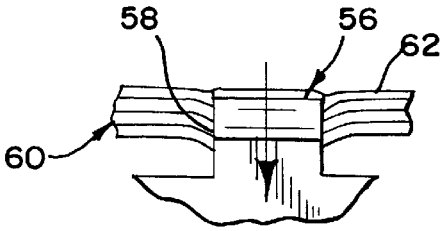
FIG. 7 PRIOR ART
FIG. 7 is a side view of a prior art rectangular-shaped tooth pulling away from the cut multiple sheets.

Preferably, as shown in FIG. 5, the teeth 34 have a bevelled edge 33 to facilitate the cutting through multiple layers of sheet material or web. Alternatively, the tooth may be bevelled in various other angles and shapes, and may be bevelled on one face or faces. The beveling provides additional relief along the faces of the teeth.

It should be appreciated that the present invention may be configured as appropriate for the intended application. The embodiments described above are to be considered in all respects only as illustrative and not restrictive. The scope of the invention is indicated by the following claims rather than by the foregoing description. All changes which come within the mean and range of equivalency of the claims are to be embraced within their scope.

I claim:

1. Rotary cutting apparatus comprising:

a knife cylinder; and a cutting rule for mounting on the knife cylinder, the cutting rule having a length, height and thickness, the cutting rule including a plurality of dovetail-shaped gaps formed along a longitudinal edge to define a plurality of dovetail-shaped cutting teeth, each tooth including an outer end and an inner base end, the outer end having a length greater than a length of the inner base end.

2. The apparatus of claim 1 wherein the outer end of each tooth is bevelled.

3. The apparatus of claim 2 wherein the tooth is bevelled on each face of the outer end.

* * * * *